US006102430A

United States Patent [19]

Reynolds

[11] Patent Number: 6,102,430

[45] Date of Patent: Aug. 15, 2000

[54] DUAL-LOCKING AUTOMATIC POSITIONING INTERFACE FOR A SNOWBOARD BOOT BINDING

[76] Inventor: Dwight H. Reynolds, 679 Fox Ct. East, Unit C, Redwood City, Calif. 94061

[21] Appl. No.: 09/074,202

[22] Filed: May 7, 1998

[51] Int. Cl.[7] ..... A63C 9/081

[52] U.S. Cl. ..... 280/618; 280/14.2

[58] Field of Search ..... 280/14.2, 618, 280/620, 626, 631, 630, 634; 403/78, 79, 164

[56] References Cited

U.S. PATENT DOCUMENTS

| | | | |
|---|---|---|---|
| 4,037,978 | 7/1977 | Connelly | 403/164 |
| 4,728,116 | 3/1988 | Hill | 280/618 |
| 4,741,550 | 5/1988 | Dennis | 280/618 |
| 4,964,649 | 10/1990 | Chamberlin | 280/618 |
| 5,028,068 | 7/1991 | Donovan | 280/618 |
| 5,044,654 | 9/1991 | Meyer | 280/613 |
| 5,190,311 | 3/1993 | Carpenter et al. | 280/618 |
| 5,236,216 | 8/1993 | Ratzek | 280/607 |
| 5,261,689 | 11/1993 | Carpenter et al. | 280/618 |
| 5,354,088 | 10/1994 | Vetter et al. | 280/618 |
| 5,356,170 | 10/1994 | Carpenter et al. | 280/618 |
| 5,499,837 | 3/1996 | Hale et al. | 280/607 |
| 5,553,883 | 9/1996 | Erb | 280/607 |
| 5,577,755 | 11/1996 | Metzger | 280/607 |
| 5,584,492 | 12/1996 | Fardie | 280/14.2 |
| 5,586,779 | 12/1996 | Dawes | 280/14.2 |
| 5,667,237 | 9/1997 | Lauer | 280/607 |
| 5,791,678 | 8/1998 | Perlman | 280/618 |
| 5,826,910 | 10/1988 | Ricks et al. | 280/618 |
| 5,890,729 | 4/1999 | Bayer et al. | 280/618 |

*Primary Examiner*—Kevin Hurley
*Assistant Examiner*—Kevin McKinley
*Attorney, Agent, or Firm*—Quarles & Brady

[57] ABSTRACT

A dual-locking rotational device with an escape mechanism for interface between a snowboard and the boot binding of a snowboarder's forward foot is disclosed. The present invention makes possible automatic positioning and repositioning of a snowboarder's forward foot boot binding from a transverse downhill position to a comfortable walking forward foot position and back again to the transverse downhill position. In particular, the present invention includes a swivel ring or disk positioned between the boot binding frame and the snowboard, and a locking mechanism which engages with the swivel ring or disk, to allow the swivel ring or disk, and thus the boot binding frame and the snowboarder's forward foot, to move between the transverse downhill position and the comfortable walking forward foot position. The present invention further includes a swivel disk retainer ring or disk for attaching the dual-locking rotating device to the top surface of the snowboard.

12 Claims, 12 Drawing Sheets

DUAL-LOCKING AUTOMATIC POSITIONING INTERFACE FOR A SNOWBOARD BOOT BINDING

FIELD OF THE INVENTION

This invention relates generally to snowboard boot binding systems, and specifically to an automatic, instant positioning and repositioning mechanism permitting the forward foot boot binding on a snowboard to be automatically rotated into a locked comfortable walking forward position, later automatically unlocked and rotated to a transverse locked position when the snowboarder is ready to travel downhill.

BACKGROUND OF THE INVENTION

Snowboarding has been a rapidly growing winter sport for nearly two decades. Most recently, snowboarding has enjoyed its first year as an official Olympic sport. Traditional skis are designed so that each foot of the skier (within its own boot) is firmly fastened to its own ski, oriented along the center line of the ski. Unlike skis, a snowboard is used by fastening both feet with boot bindings to a single board. The snowboard is ridden in a standing position facing sideways with the feet positioned side by side, with some separation. In other words, the feet are positioned transversely across the snowboard. In particular, one foot is fixed near the front of the board and the other foot is fixed near the back of the board, with the toes directed toward the same side of the board. Snowboarding is somewhat comparable to surfing except on a surfboard the surfboarder's feet are not bound with the board.

Once a snowboarder's feet are positioned transversely across the snowboard, the snowboarder travels down the ski slopes in much the same manner as a surfer "surfs " ocean waves, or a skateboarder travels downhill. In particular, the snowboarder shifts his or her body weight backward and forward, side-to-side and with heel-to-toe pressure to apply body forces and torque to control the snowboard's direction of travel and turns in a downhill snowboard run.

Presently, there are generally two types of boot binding mechanisms used to fix and control the necessary transverse position of each foot on the snowboard during the downhill run. The first type of binding is a soft boot binding which are classified into two different categories. The first type soft boot bindings are commonly referred to as the frame and strap type binding. These soft boot bindings incorporate a boot binding frame, usually with raised sides and back, fixed to a snowboard, with some limited means of adjustment depending on the size of the foot. Usually, the binding frame can be adjusted relative to the snowboard by first removing the boot from the binding frame and loosening or removing the fasteners which hold the binding frame to the snowboard. Straps, buckles, and fasteners are mounted onto this boot binding frame to facilitate strapping or binding of a snowboarder's soft boots into the boot binding frame and thereby onto the snowboard in a firm and fixed transverse downhill position.

The second type of soft boot bindings, which are called the step-in latch type, incorporate a boot binding frame, some without raised sides and back, fixed to a snowboard, with some limited means of adjustment. Usually, the binding frame can be adjusted relative to the snowboard by removing the boot and loosening or removing the fasteners which hold the binding frame to the snowboard in a fixed transverse position. This type of snowboard boot binding frame usually has various other mating and locking devices, such as bails and latches, which are built into and/or attached to the bottom or sides of the boot and to parts of the boot binding frame fastened to the top of the snowboard.

The second type of boot binding mechanisms are hard boot bindings. Hard boot bindings incorporate a hard boot binding frame, which has hard protrusions. The hard boot binding frame is also fixed to a snowboard. These binding frames generally include a toe clip and a heel clip, or bails, to fasten a snowboarder's hard boot onto the hard boot binding frame and thus into a fixed transverse downhill position. These bindings are similar to early ski bindings, but are fixed transversely across the snowboard.

There are problems associated with the above-described boot binding mechanisms. One problem is that soft boot or hard boot bindings generally require that the snowboarder must preselect the precise angle of transverse foot position most suitable for the individual snowboarder's style. After the bindings are fastened on to the top of the snowboard, the transverse foot position is locked into the binding's orientation and usually may not be rotated without the use of a tool, once the boot is removed from the binding frame. With both feet locked transversely into the snowboard this way, it is very difficult, if not impossible, for a snowboarder to move across level areas of snow, up slight inclines, along in chair-lift lines and onto the chair-lift.

Therefore, when moving on level areas, and into and through chair-lift lines, the customary practice is for the snowboarder to remove his or her back foot from its binding, leave his or her forward foot fixed into its binding in the transverse position, and then try to propel himself or herself and the snowboard along in a scooter/skateboard fashion. With the forward foot locked in the preselected transverse position and the other foot out of the binding, even a casual observer can see the front foot (and thus the front leg) is contorted to one side, forcing the snowboarder to walk in an extremely pigeon-toed manner. This obviously results in undue stresses to the snowboarder's joints and body. It is therefore quite clear that there are two distinct foot positions needed for snowboarding activity: (1) a personally preselected transverse downhill position and (2) a natural, comfortable forward walking position.

Another problem with the present snowboard binding mechanisms is that when only one foot is attached, the contorted pigeon-toed orientation of the attached foot tends to cause a lack of control. The back of a snowboard tends to fishtail or move erratically from side to side as the snowboarder tries to travel across flat areas, such as in chair-lift lines. Chair-lift lines are particularly troublesome because they are often narrow with many lines abreast. Thus, skiers and snowboarders must travel with both feet and skis oriented parallel and in the line of travel through the chair-lift line in order to avoid other persons' skis and snowboards. Snowboarders especially have difficulty in such lines because of the fishtailing and erratic uncontrolled movement of the snowboard which often knocks into and over skis of nearby skiers.

In addition, for the same reason, while the snowboarder is riding chair-lifts with other skiers, the snowboard tends to hang at a sideways angle, rather than pointing straight forward in a position parallel with the skis of the other riders on the chair-lift. Here again, the snowboard often bangs into or on top of adjacent skis much to the discomfort of skiers since chipping and scratching of their equipment can and does occur.

Another problem with the present snowboard binding mechanisms is that they tend to cause personal physical discomfort and injury. Snowboarders experience stress to their joints from undue torque and strain on their ankle, knee, and hips when walking pigeon-toed style. While younger participants in the sport may not notice detrimental physical effects when they are happening, they often suffer the consequences later on. Wiser participants in the sport recognize and experience the adverse effects of this contorted position.

The present snowboard binding mechanisms tend to look extremely uncomfortable and hard to maneuver. When snowboarders are moving along in chair-lift lines, or riding up on chair-lifts, they lack dignity and style due to the extremely awkward, pigeon-toed (transverse foot) positioning of their feet. The sport of skiing has long made style and dignity important aspects of life on the slopes. The present state of the art, that is, the pigeon-toed configuration, of snowboarding lacks elements that would permit such dignity and style.

As a result of these problems, some ski resorts prohibit or restrict snowboarding. A number of binding attachment devices have been applied to permit rotation of the bindings relative to the snowboard but, to date, none of these approaches allow the user to automatically make instantaneous positioning and repositioning of the boot binding for the snowboarder's forward foot from the transverse downhill position into the natural walking forward foot position and then back again to the transverse downhill position, without the use of tools and with only a single lever action for the whole cycle.

There are several patents directed to release bindings or rotational adjustment bindings for snowboards, which include U.S. Pat. No. 5,667,227, issued to Lauer; U.S. Pat. No. 5,584,492, issued to Fardie; U.S. Pat. No. 5,577,755, issued to Metzger; and U.S. Pat. No. 5,499,837, issued to Hale, et al. These patents are directed to releasable locking mechanisms and levers to disengage a rotational mechanism to permit rotation of a snowboard binding without removing the boot or use of external tools. None of these devices, however, provides automatic positioning, locking, repositioning and locking of the binding to and from the forward walking foot position to the preselected transverse foot position.

Other patents include U.S. Pat. Nos. 5,356,200 and 5,190,341, both issued to Carpenter, et al.; U.S. Pat. No. 5,226,216, issued to Ratzek; and U.S. Pat. No. 5,044,654, issued to Meyer. These patents are directed to making fine adjustments affecting the degree of transverse foot position during downhill runs as dictated by a snowboarder's personal preference or providing a safety release from a binding when a snowboarder takes a fall. It is apparent that these patents are directed toward entirely different objectives and do not solve the above problems.

Another patent, U.S. Pat. No. 4,964,649, issued to Chamberlin, readily permits changes of foot position, but these changes are from one transverse position to another transverse position for the purpose of providing a snowboard rider with greater responsiveness and enhanced maneuverability during a downhill run. These changes are accomplished by a complex system designed to make angular adjustment by application of body torque during a ride to vary the transverse position and then having the feet return to an original pre-set transverse position, but it applies only during that same downhill snowboard run. Again, it is apparent that this patent is directed toward entirely different objectives and does not solve the above problems.

Another patent, U.S. Pat. No. 5,354,088 issued to Vetter, shows an adjustable transverse stance angle adjustment capability, which provides quick release of the back boot from back binding of the snowboard, rather than the front binding. Once again, this patent is directed toward entirely different objectives and does not solve the above problems.

One patent which purports to provide adjustability from the transverse downhill position to the chair-lift riding position is disclosed in U.S. Pat. No. 5,028,068, issued to Donovan. While the patent claims that the claimed complex mechanism makes possible quick adjusting from an unlocked position to a second position which can then be locked, it, like the others, does not provide precise or automatic positioning to any preselected position, nor instantaneous return to any precise previous position. Further, this patent does not disclose instantaneous and automatic locking into any preselected position, nor automatic change of position back (and locking) into a preselected transverse downhill position without the use of hands.

Accordingly, it would be desirable to provide a snowboard boot binding system that eliminates or decreases the above discussed problems associated with current snowboard binding systems.

SUMMARY OF INVENTION

One aspect of the present invention provides a dual-locking automatic binding positioning interface for a snowboard boot binding which includes a board, where the board has a longitudinal axis and a transverse axis, a frame for receiving a person's foot, where the frame is connected with the board, and means for automatically rotating the frame in relation to the board. The rotating means includes a soft-lock coupling point when the frame is positioned parallel to the longitudinal axis of the board and a hard-lock coupling point when the frame is positioned transversely to the longitudinal axis of the board.

The rotating means may include a swivel disk connected to the frame and a locking means which engages with the swivel disk. In particular, the circumference of the swivel disk includes a soft-lock coupling point and downhill locking coupling point formed therein, and the locking means includes a locking detent coupler, where the locking detent coupler is received within the soft-lock coupling point for the frame to be positioned parallel to the longitudinal axis of the snowboard and the downhill coupling point for the frame to be positioned transversely to the longitudinal axis of the board.

Another aspect of the present invention discloses a rotating binding system for use with a downhill sliding device. The rotating binding system uses a swivel disk mounted on the downhill sliding device. The swivel disk has a downhill locking coupling point and a soft-locking coupling point. A swivel disk retainer ring covers the outer edge of the swivel disk. During operation, the swivel disk is capable of rotating within the swivel disk retainer ring. A locking means selectively engages the downhill locking coupling point and the soft-lock coupling point so that the swivel disk will not rotate. The soft-lock coupling point is capable of being released when the snowboarder applies pressure to the rotating binding system with his or her leg. The downhill locking coupling point remains forcibly engaged by the locking means until the snowboarder releases the locking means manually by deflecting the detent release lever.

The swivel disk has a plurality of fastening devices for receiving a plurality of fasteners. The plurality of fastening devices are located on the top surface of the swivel disk and are designed to be connected with a conventional snowboard boot binding frame. A swivel disk riser may also be connected with the top surface of the swivel disk that is also capable of being connected with a conventional snowboard boot binding frame.

The present invention also discloses a method for dual-locking a snowboard binding frame. In the invention, a mounting surface having a longitudinal axis and a transverse axis is provided. The mounting surface in the preferred embodiments would be the top surface of the snowboard, however, one skilled in the art would recognize that the dual-locking snowboard binding frame could be used with other downhill sliding devices having a flat mounting surface. A frame for receiving a person's foot is provided that holds the snowboarder's foot in place while using the device. During operation of the preferred embodiment the frame is capable of rotating in relation to the mounting surface from and to a soft-lock coupling point when the frame is positioned parallel to the longitudinal axis of the mounting surface and a hard-lock coupling point when the frame is positioned transversely to the longitudinal axis of the mounting surface.

Another aspect of the present invention discloses a rotating binding for a snow recreation device. The rotating binding uses a swivel disk having a downhill locking coupling point, a soft-lock coupling point, and a connector for securing the swivel disk with the snow recreation device. The connector secures the swivel disk with the snow recreation device in a manner that allows the swivel disk to rotate about its center axis. A locking detent device capable of forcibly engaging the downhill locking coupling point so that in conjunction with the stop block(s), the dual-locking swivel disk does not rotate; and alternately engaging the soft-lock coupling point so that in conjunction with the stop block(s), the dual-locking swivel disk does not rotate further away from the hard-lock position and does not rotate toward the hard-lock position without application of rotational force in that direction sufficient to overcome the force applied by the compressive spring.

The present invention also discloses a rotating boot binding system for a snowboard. In the invention, the rotating boot binding system uses a boot binding frame having a slip surface retainer disk and a swivel disk. As in the other preferred embodiments, the swivel disk has a downhill locking coupling point and a soft-lock coupling point. A locking detent device is connected with the snowboard which forcibly engages the downhill locking coupling point and the soft-lock coupling point. A slip surface retainer disk is connected with the boot binding frame and the snowboard. The slip surface retainer disk allows the boot binding frame to rotate around the slip surface retainer disk. Therefore, this embodiment of the present invention combines the swivel disk and the boot binding frame in one structure thereby reducing the number of components necessary to assemble and use the disclosed invention.

Finally, another aspect of the present invention discloses a rotating binding system for use with a downhill sliding device. The rotating binding system comprises a swivel disk connected with the top surface of the downhill sliding device, said swivel disk being capable of rotating; a full or partial outer ring that mates with a portion of the outer edge of the swivel disk, said full or partial outer ring having a downhill locking coupling point and a soft-lock coupling point; and a locking means connected with the swivel disk for selectively engaging the downhill locking coupling point and the soft-lock coupling point so that the swivel disk will not rotate. In this preferred embodiment of the present invention, the downhill locking coupling point and the soft-locking coupling point are located on the full or partial outer ring instead of the swivel disk. The locking means is located on the swivel disk instead of on the board at a position adjacent to the swivel disk.

DETAILED DESCRIPTION OF THE PREFERRED EMBODIMENTS

Figure 1:
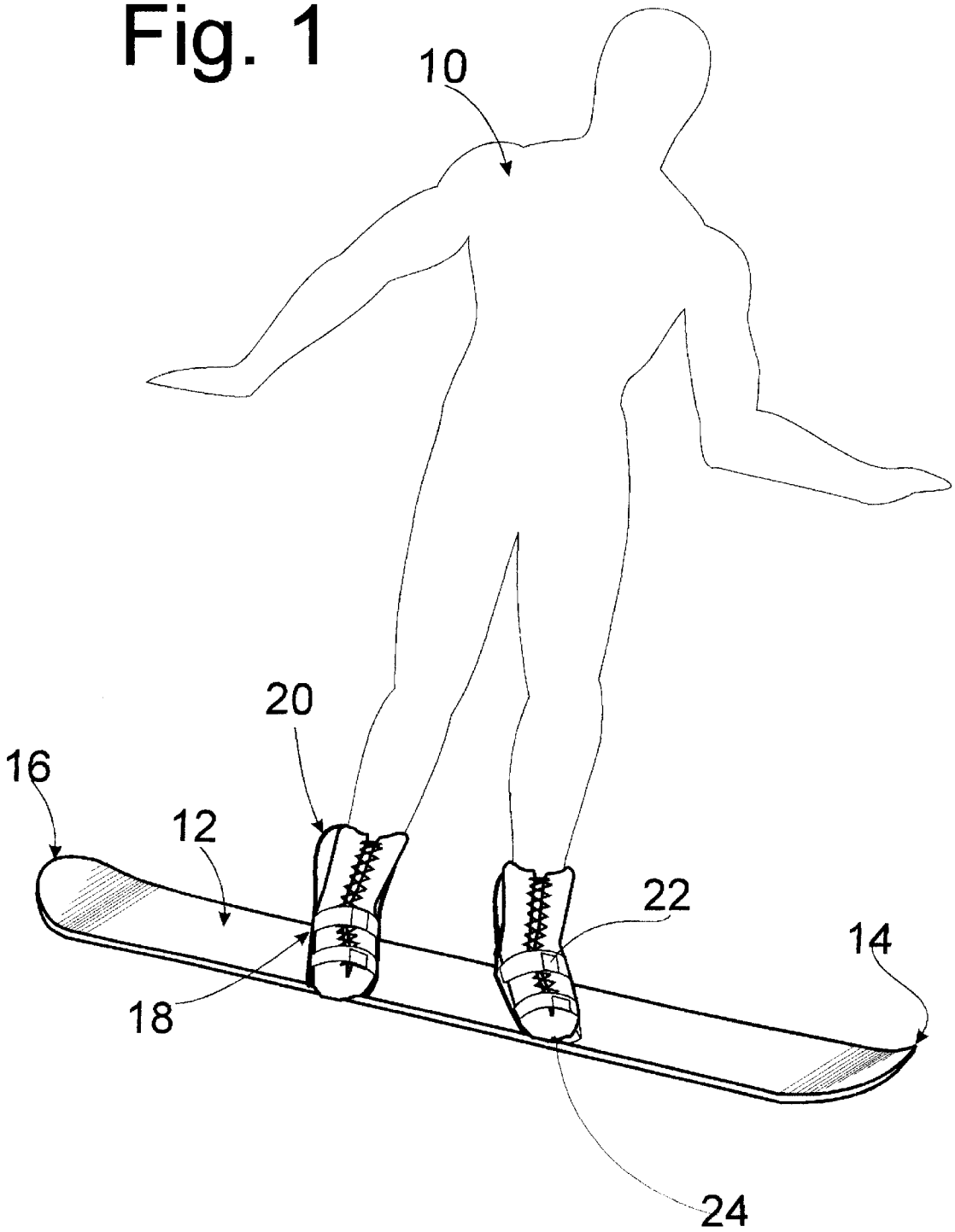
FIG. 1 is a view of a snowboarder using a prior art snowboard binding system depicted traveling downhill.
Figure 2:
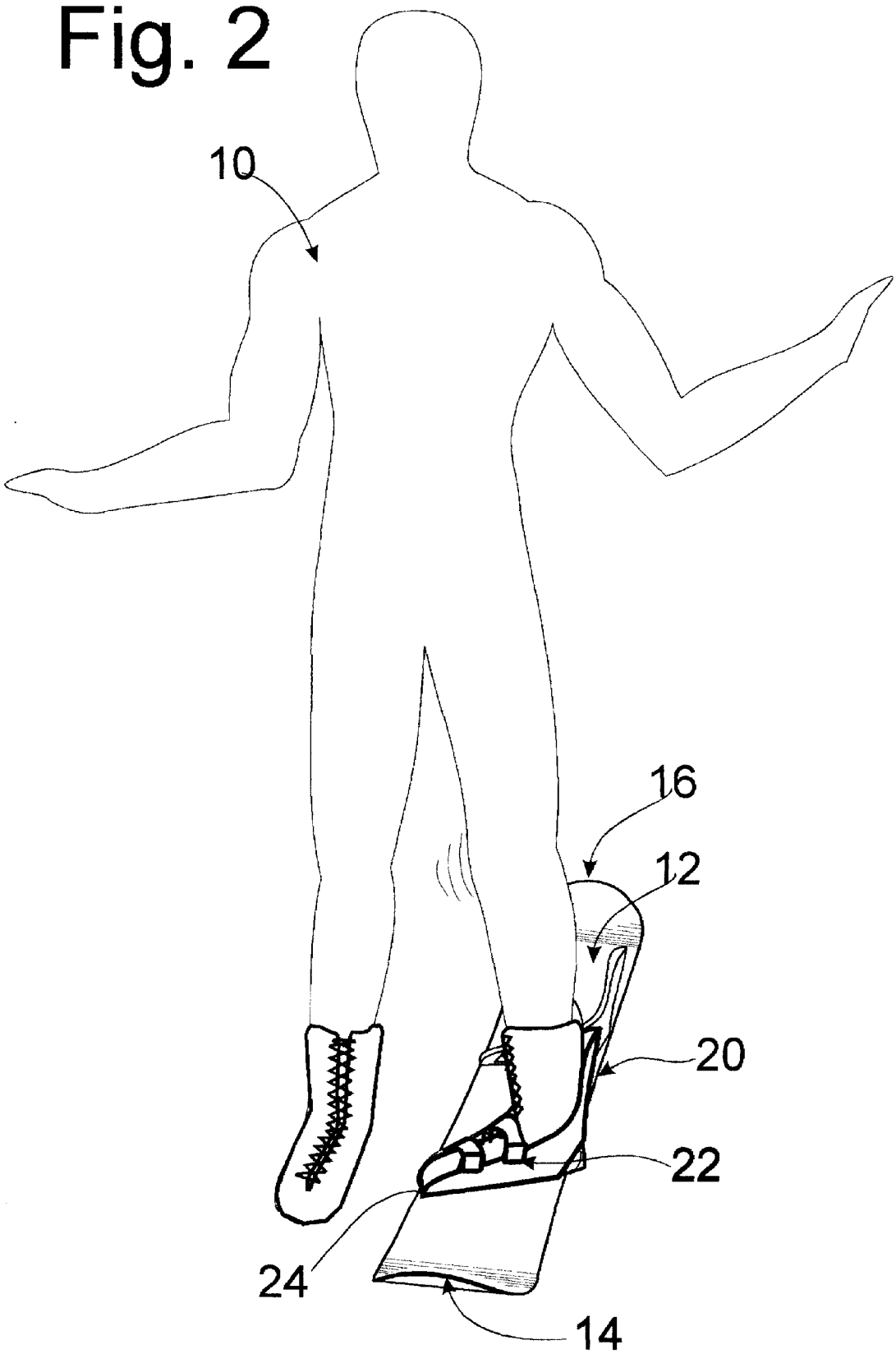
FIG. 2 is a view of the snowboarder of FIG. 1, illustrating the contorted and twisted positioning of the snowboarder's legs and feet of present devices after the snowboarder has removed his or her back foot from the binding mechanism.

To illustrate the primary problem of present snowboard boot bindings, FIGS. 1 and 2 illustrate such devices. In particular, FIG. 1 illustrates a snowboarder 10 on top of a snowboard 12 making a snowboard run in the transverse downhill foot position using a conventional soft boot strap and buckle binding system. The snowboard 12 includes a front tip 14 and a back end 16. As depicted, the snowboarder's feet are firmly bound or locked onto the snowboard 12 by the binding system which includes a snowboard boot binding frame 20 and a plurality of binding belts 22. The boot binding frame 20 is bolted to the top of the snowboard 12. The front tip 24 of the boot binding frame 20, and thus the front of the snowboarder's forward foot, points transversely across the snowboard 12.

FIG. 2 shows the prior art boot binding frames 20 after the back foot has been removed from the back boot binding of the snowboard 12, as is customary when the snowboarder 10 needs to move across level snowy areas, such as when moving from the bottom of a hill to and through chair-lift lines. In particular, FIG. 2 depicts the snowboarder's forward foot still fastened into the forward boot binding frame 20 by the plurality of boot binding belts 22. Because the boot binding belts 22 and the boot binding frames 20 are firmly fixed to the snowboard 12 in the transverse position, the snowboarder's forward foot points severely in this direction, in a painfully awkward, contorted, pigeon-toed walking position.

Figure 3:
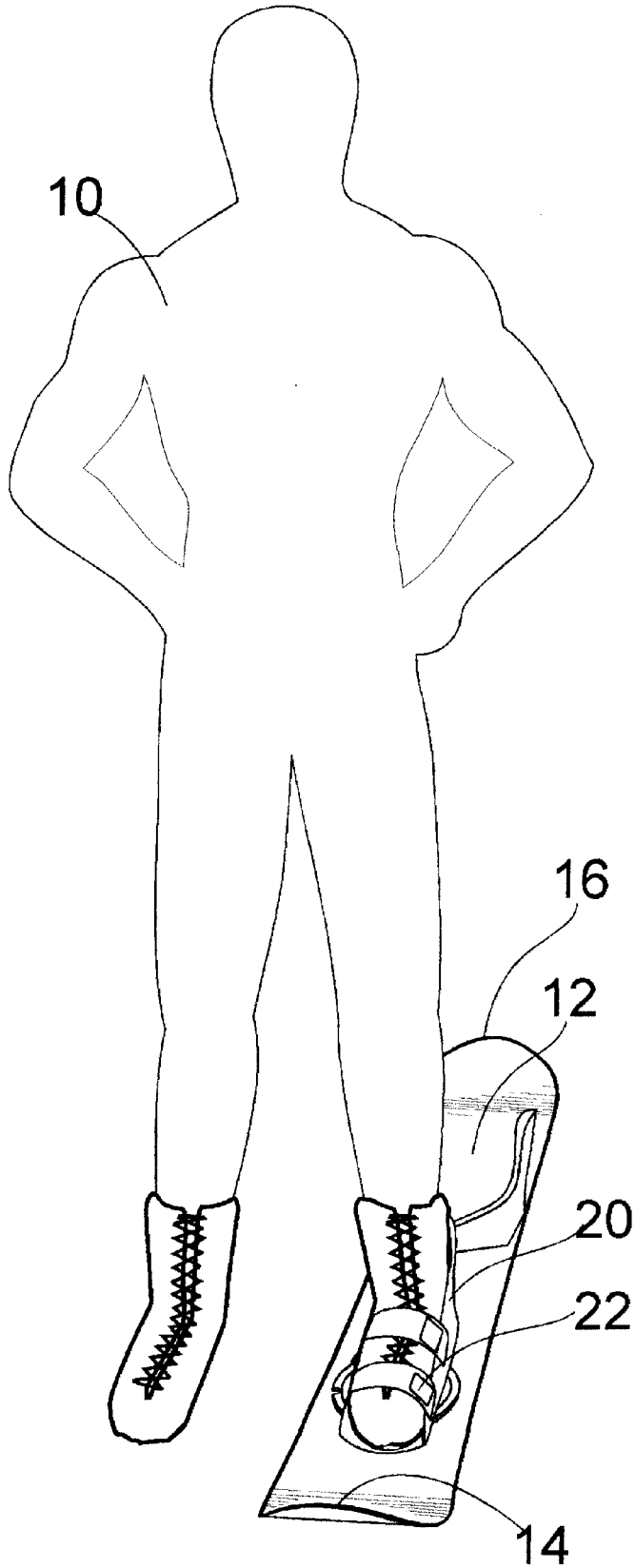
FIG. 3 is a view of a snowboarder using the present invention, after the snowboarder has removed his or her back foot from the binding mechanism.

FIG. 3 illustrates the comfortable walking forward position of the present invention. As shown, the present invention is centered on the snowboard 12. However, the present invention may be located at various points relative to the boot binding frame 20 and the snowboard 12, depending on a wide variety of desired effects, preferences and/or associated equipment. In particular, the present invention could be positioned near the edge of the snowboard 12 or more under the toes of the snowboarder's forward foot.

As shown in FIG. 3, the snowboarder 10 has his forward foot fastened into the boot binding frame 20 by a plurality of boot binding belts 22, which are fastened to the top of the snowboard 12. Because the present invention allows the boot binding frame 20 to swivel, the snowboarder 10 may comfortably walk in a forward position, thereby relieving the joint stresses caused by current devices. This forward-walking position automatically permits control, safety, comfort, convenience and aesthetics not yet known in snowboarding.

Figure 4:
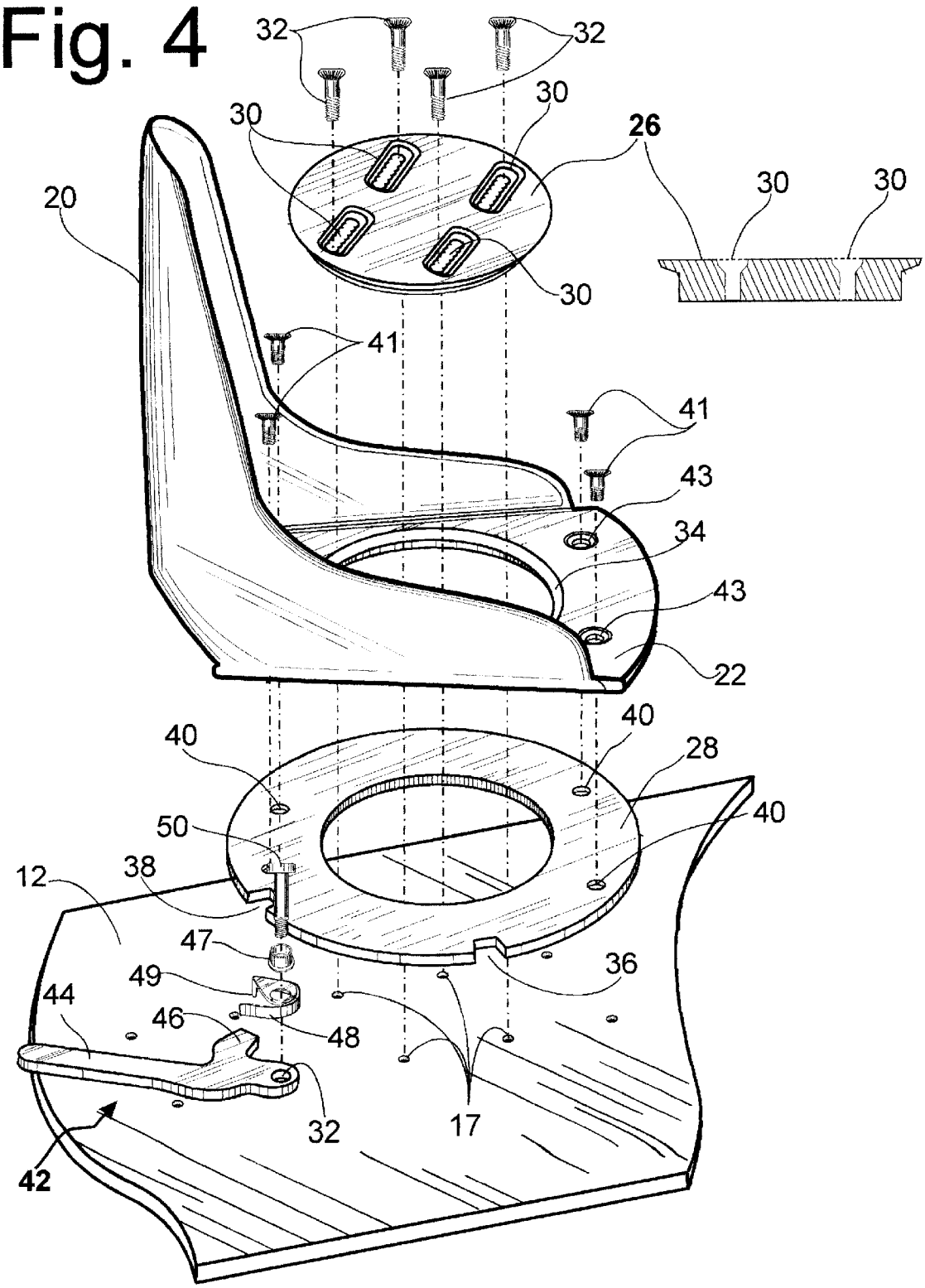
FIG. 4 is a simplified diagrammatic view of a preferred embodiment of the present invention.

As illustrated in FIG. 4, a preferred embodiment of the present invention includes a boot binding retainer slip disk 26 and a dual-locking swivel ring 28. The swivel ring 28 is positioned between a boot binding frame 20 and the top of the snowboard 12. The boot binding retainer slip disk 26 and the swivel ring 28 permit the boot binding frame 20, and thus the snowboarder's forward foot, to be quickly repositioned, into a generally forward-walking position, as shown in FIG. 3. In particular, FIG. 4 illustrates an exploded view of the snowboard boot binding retainer slip disk 26 which includes holes formed therein, which are fastener holes 30. Binding retainer disk screws 32 are inserted through the fastener holes 30 to connect the boot binding retainer slip disk 26 to the snowboard 12. In addition, the snowboard boot binding frame 20 has a boot binding retainer disk receptacle 34, which has a smooth inner circular surface which is slightly larger than the smooth circular outer surface of the boot binding retainer slip disk 26. Because the boot binding retainer slip disk 26 is slightly smaller in diameter than the disk receptacle 34 and slightly thicker than the combined thickness of the dual-locking swivel ring 28 and the base of the boot binding frame 20, once the boot binding retainer slip disk 26 is connected to the snowboard 12 by screws 32, the boot binding frame 20 and the dual-locking swivel ring 28 will also be retained securely on the top of the snowboard 12 yet permitted to rotate.

As stated above, the dual-locking swivel ring 28 is positioned between the boot binding frame 20 and the top of the snowboard 12. The dual-locking swivel ring 28 has two notches formed into its periphery. One notch is a hard-lock coupling point 36, while the other notch is a soft-lock coupling point 38. The hard-lock coupling point 36 is oriented for the downhill transverse position as depicted in FIG. 1, while the soft-lock coupling point 38 is oriented for the walking forward positions as depicted in FIG. 3. The coupling points 36, 38 on the swivel ring 28 are located in certain predetermined positions. The coupling points 36, 38, however, are not limited to these positions, but may be located at various points around the circumference of the swivel ring 28, including, but not limited to, the top, the bottom, the right side, the left side or both sides. In addition, a plurality of coupling points 36, 38 may be used; however, in the preferred embodiment, only two are used.

The swivel ring 28 has four binding threaded holes 40. While four threaded holes 40 are shown in the preferred embodiment, one skilled in the art would recognize that there may be more than or less than four holes. As depicted, a plurality of screws 41 are inserted through holes 43 in the boot binding frame 20 and securely screwed into the plurality of threaded holes 40 located on the top surface of the dual-locking swivel ring 28. The boot binding retainer slip disk 26 is then inserted into the boot binding retainer disk receptacle 34 and bolted to the top surface of the snowboard 12 using the screws 32 which fit through holes 30 and into the threaded holes 17, to fasten and fix the boot binding frame 20 to swivel ring 28.

The boot binding retainer slip disk 26 and the boot binding retaining receptacle 34 may each have friction surfaces incorporated at the points where the two components connect. One skilled in the art of friction surfaces would recognize that a slip effect may be obtained under certain circumstances even though both surfaces are not smooth. During operation, in response to movement by the snowboarder's leg and foot, the frame 20 will rotate on the swivel ring 28 while the boot binding retainer slip disk 26 will remain stationary. The boot binding retainer slip disk 26 is connected with the top surface of the snowboard 12 with threaded holes 17 by screws 32. In this embodiment, as a retrofit, one might select the option to make the retainer slip disk 26 smooth while leaving the mating portion of the swivel ring 28 to slip on the tips of common gear teeth.

Another aspect of the invention is a locking mechanism 42, which is the means for locking the present invention in either the hard-lock coupling point 36 or the soft-lock coupling point 38. The locking mechanism 42 includes a locking detent coupler lever 44 which has a locking detent coupler 46 which fits within both of the coupling points 36, 38. The locking mechanism 42 also includes a detent coupling compressive spring 48 with a lock pin 49 and a counter stop 50. The actual locking mechanism 42 can take many forms, including latch-notch, bolt-hole, slide-slot, tooth-cog, disk, plate, ring, and the like, or various combinations of these can also be effectively utilized. Those skilled in the art would recognize that many variations exist when designing the locking mechanism 42 and that the basic function for the locking mechanism 42 in the present invention is to prevent the swivel ring 28 from rotating into an undesired position.

As shown, the locking mechanism 42 has its locking detent coupler lever 44 positioned to be fastened to the snowboard located to the right rear side of the dual-locking swivel ring 28. The locking mechanism 42, however, may be mounted at alternate locations on the snowboard 12, including, but not limited to, the front, center, left or right of the snowboard 12. In its position on the snowboard 12, the locking mechanism 42 keeps the hard-lock coupling point 36 forcibly engaged by the force of the compressive spring 48, which holds the locking detent coupler 46 in place, and by the fact that any rotational force which would tend to bring the soft-lock coupling point 38 toward the locking detent coupler 46 would strengthen the lock with the hard-lock coupling point 36 on the dual-locking swivel ring 28. The locking detent coupler 46 and the counter stop 50 block any further rotation of the hard-lock coupling point 36 past the locking detent coupler 46. Thus, once the swivel ring 28 is in the hard-locked coupling point 36, no rotation is possible in either direction until the locking detent coupler 46 is released by force applied to the locking detent coupler lever 44.

At the soft-lock coupling point 38, the locking mechanism 42 operates differently in that it permits automatic release in the direction of the hard-locked coupling point 36 when sufficient force is applied by the foot, yet no rotation past the soft-lock coupling point 38 is permitted by the counter stop 50. This is accomplished by the position of the locking mechanism 42 on the snowboard 12. In the invention, the locking detent coupler 46 and the counter stop 50 block the rotation of the swivel ring 28 so that the swivel ring 28 will not travel past either of the coupling points 36, 38. During operation, the resistance of the compressive spring 48 acts to hold the locking detent coupler 46 engaged with the soft-lock coupling point 36 and the counter stop 50 blocks rotation beyond the soft-lock coupling point 36. However, when enough pressure is applied to overcome the resistance supplied by the compressive spring 48, the swivel ring 28 will rotate toward the hard-lock coupling point 36 eventually locking in place with the locking detent coupler 46.

The counter stop 50, which may include any secondary stops, may be made in a variety of manners, depending on the size and position of the swivel ring 28. The counter stop 50 may easily be enlarged, have a plurality of bolts, have a connecting bar between bolts, or may be a combination of the above-mentioned objects that are spaced apart from each other in separated positions. In this manner, the counter stop 50 may be used to support a plurality of stop points at various points selected by different snowboarders. In addition, the compressive spring 48 must have a place to be attached with the snowboard 12 or any other convenient point so that the compressive spring 48 will exert force on the locking detent coupler 46. One skilled in the art would recognize that springs must be attached to two separate surfaces in order to exert force on a moving surface.

Figure 5:
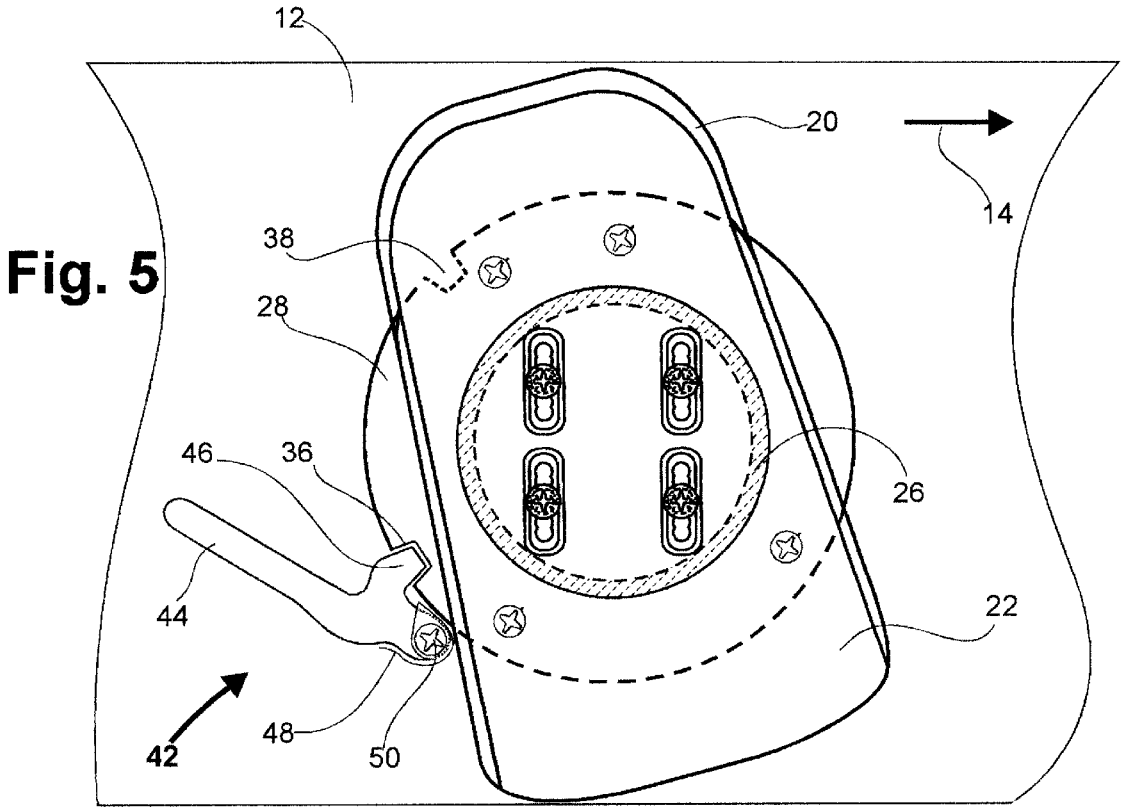
FIG. 5 depicts a top view of the boot binding frame in the hard-locked position which holds the snowboarder's foot in the preselected transverse position.
Figure 6:
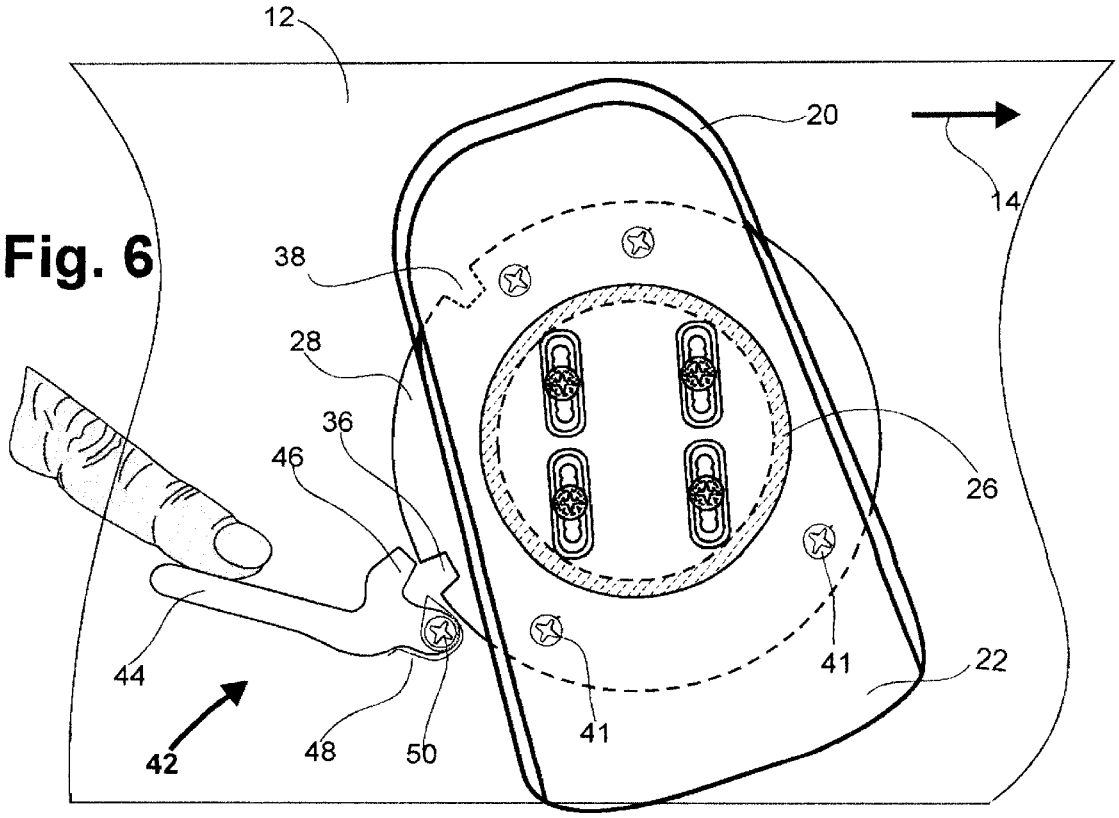
FIG. 6 depicts a top view of the boot binding frame immediately after finger pressure has been applied to release the frame from the hard-locked position.
Figure 7:
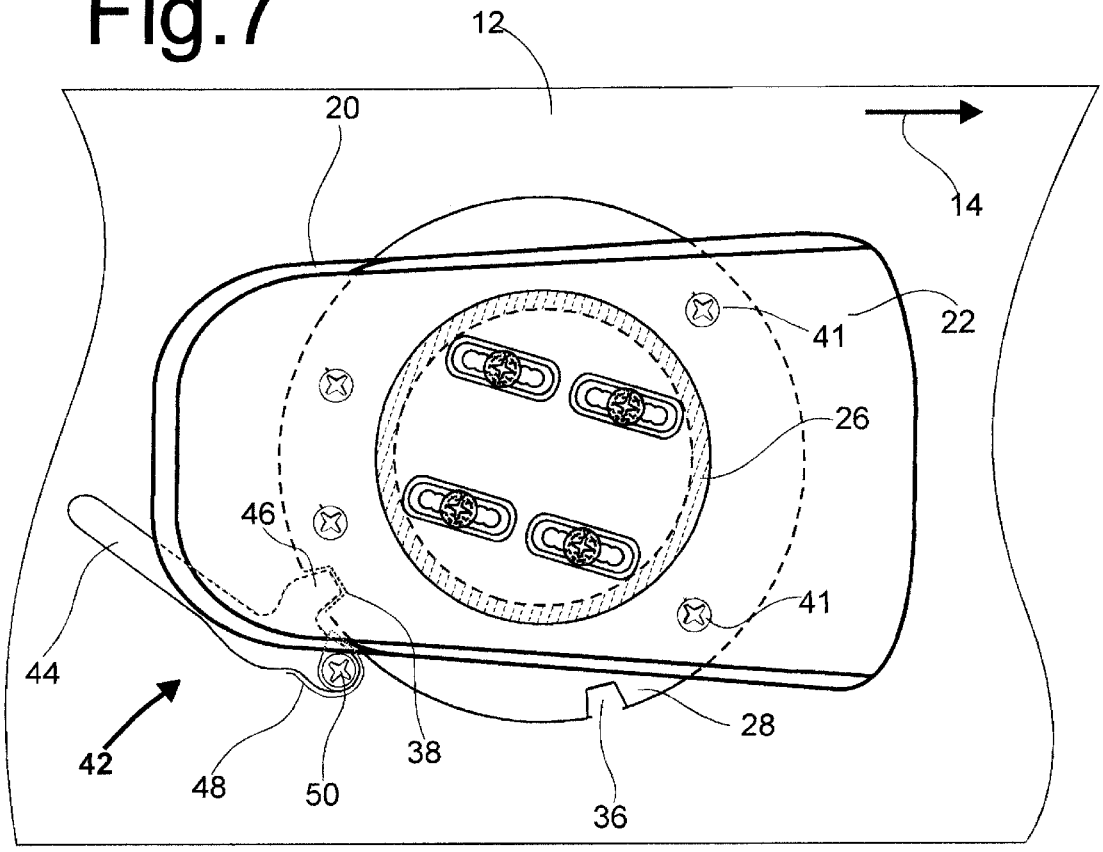
FIG. 7 illustrates a top view of the boot binding frame in the soft-locked position which holds the snowboarder's foot in the normal walking position.

The operation of the embodiment depicted in FIG. 4 is further illustrated in FIGS. 5–7. FIG. 5 shows a top view of the embodiment depicted in FIG. 4, wherein the hard-lock coupling point 36 of the dual-locking swivel ring 28 is in the hard-locked position. This position is obtained when clockwise rotation of the dual-locking swivel ring 28 brings the side of the boot binding frame 20 into contact with the elevated counter stop 50 which is a part of the locking mechanism 42. The locking mechanism 42 also functions to limit the rotation of the dual-locking swivel ring 28. At the instant of contact, the locking detent coupler 46 is thrust into a mated position with the hard-lock coupling point 36 by the force of the compressive spring 48.

Once the hard-lock coupling point 36 is reached, no rotation in either direction is possible until the detent coupler lever 44 is manually released. This lock is initiated and supported by the compressive spring 48, but is not maintained thereby. The lock is maintained by the exercise of rotational forces acting on the assembly due to the locational relationship of the counter stop 50, which is located in proximity to the tangent running through the point where the opening of the hard-lock coupling point 46 is established on the swivel ring 28. Thus, counter-clockwise forces work to drive the locking detent coupler 46 into a more secure lock since the locking detent coupler 46 cannot be forced toward the counter stop 50 which is positioned at or near the same tangent.

FIG. 6 also illustrates the top view of the embodiment disclosed in FIG. 4, in sequence immediately after a light finger pressure has been applied to the detent coupler lever 44 to overcome the pressure of the compressive spring 48. Once the pressure of the compressive spring 48 has been overcome, the swivel ring 28 is free to rotate toward the soft-lock coupling point 38 and does so automatically because that is the natural position for the foot at the time of release.

FIG. 7 also illustrates the top view of the embodiment disclosed in FIG. 4, in which the boot binding frame 20 is swiveled to reach the soft-lock coupling point 38. In the soft-lock coupling point 38, the boot binding frame 20 has made contact with the counter stop 50 of locking mechanism 42. This now acts to limit the counter-clockwise rotation of the swivel ring 28. At the instance of contact, the locking detent coupler 46 is thrust into a mated position with the soft-lock coupling point 38 by the force of the compressive spring 48. However, unlike in the downhill-locking coupling point 46, the lock is maintained only by the pressure exerted by the force of the compressive spring 48 which maintains the locking detent coupler 46 in the mating position with the soft-lock coupling point 38. Then, when the snowboarder wants to return to the hard-lock coupling point 46, he or she simply applies force towards the hard-lock coupling point 46. This clockwise rotational force causes the swivel ring 28 to push the locking detent coupler 46 out of the soft-lock coupling point 38. Then, the foot and assembly return to the position depicted in FIG. 5.

Figure 8:
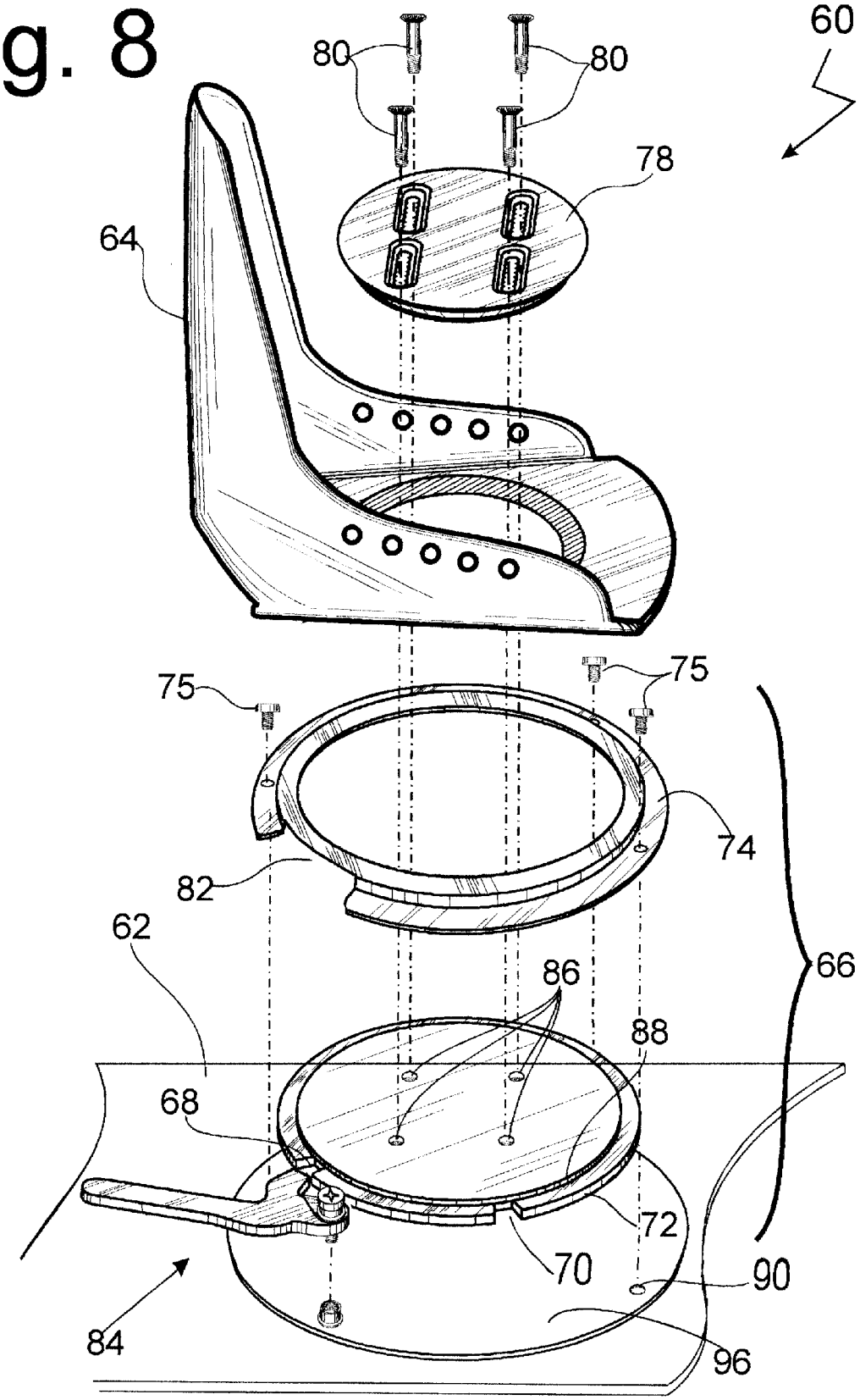
FIG. 8 is a diagrammatic view depicting a conventional binding frame connected with a preferred embodiment of the rotating binding system.

Referring to FIG. 8, a preferred embodiment of the present invention discloses a dual-locking automatic snowboard binding assembly 60. In the invention, a mounting surface 62 having a longitudinal axis and a transverse axis is provided to give a surface area for securing the dual-locking automatic snowboard binding assembly 60. A frame 64 for receiving a person's foot is provided and is connected with the mounting surface 62. Many variations on the design of the frame 64 exist and are known to those skilled in the art. The frame 64 is rotatable in relation to the mounting surface 62, wherein a rotating means 66 includes a soft-lock coupling point 68 when the frame 64 is positioned parallel to the longitudinal axis of the mounting surface 62 and a hard-lock coupling point 70 when the frame 64 is positioned transversely to the longitudinal axis of the mounting surface 62. In this embodiment, the dual-locking automatic snowboard binding assembly 60 may also be integrally formed inside the inner workings of the snowboard 62 thereby remaining out of sight. Of course, one skilled in the art would recognize that the locking mechanism 84 would still need to be located where the snowboarder can easily gain access.

In the preferred embodiment illustrated in FIG. 8, the rotating means 66 further comprises a swivel disk 72 and a swivel disk retainer ring 74. Those skilled in the art would recognize that many variations exist on the basic design of the frame 64 for a hard or soft boot, step in or buckle types, and the means for holding the frame 64 securely to the mounting surface 62. In addition, the frame 64 may be connected with the swivels disk 72 using many different attachment means such as a boot binding retainer disk 78 and bolts or screws 80. In the preferred embodiment, the swivel disk retainer ring 74 is provided with a notched location 82 for allowing a locking mechanism 84 to selectively engage the soft-lock coupling point 68 and the hard-lock coupling point 70. The entire dual-locking automatic snowboard binding assembly 60 may be connected with the mounting surface 62 using any conventional means known in the art. In the disclosed preferred embodiment, the swivel disk retainer ring 74 is fastened to the mounting surface 62 using bolts or screws 75.

The swivel disk 72 is mounted to the downhill sliding device 62 with a swivel disk retainer ring 74 which covers the outer edge of the swivel disk 72. Both the swivel disk 72 and the swivel disk retainer ring 74 are designed in such a way so that the swivel disk 72 is capable of rotating within the swivel disk retainer ring 74. As previously discussed, the swivel disk retainer ring 74 may be mounted to the downhill sliding device 62 by any conventional means known in the art. In preferred embodiments, the swivel disk retainer ring 74 would be connected with the downhill sliding device 62 using screws 75. A locking mechanism 84 for selectively engaging the hard-lock coupling point 70 and the soft-locking coupling point 68 is also provided so that the swivel disk 72 will not rotate when the soft-locking coupling point 68 or the hard-lock coupling point 70 are engaged.

The swivel disk 72 may be connected with a swivel disk riser 88 for increasing the effective thickness of the swivel disk 72 thereby allowing easier adaptability to currently produced frames 64 and boot binding retainer disks 78. In the invention, the swivel disk 72 is provided with a plurality of fastening devices for receiving a plurality of fasteners 80. The swivel disk riser 88 is provided with a plurality of apertures 86 which are located directly above the fastening devices 85 on the swivel disk 72. The plurality of apertures 86 are optimally designed to mate up with a conventional boot binding retainer disk 78 or a frame 64 having a fastening means already designed therein. Those skilled in the art would recognize that many variations exist on the design of the frame 64 and the boot binding retainer disk 78. It is sufficient to say that any assembly which holds a person's foot in place and is capable of being attached to the top of the swivel disk 72 is capable of being used with the present invention.

The plurality of apertures 86 allow the swivel disk riser 88 to mate with the fastening devices 85 that are located on the swivel disk 72. In the preferred embodiment, the swivel disk riser apertures 86 comprise holes drilled big enough to allow the plurality of fastening means 80 to pass through the swivel disk riser 88 and then securely into the swivel ring fastening devices. Optimally, the swivel 72 and the swivel disk riser 88 would be designed as a single unit.

Figure 9:
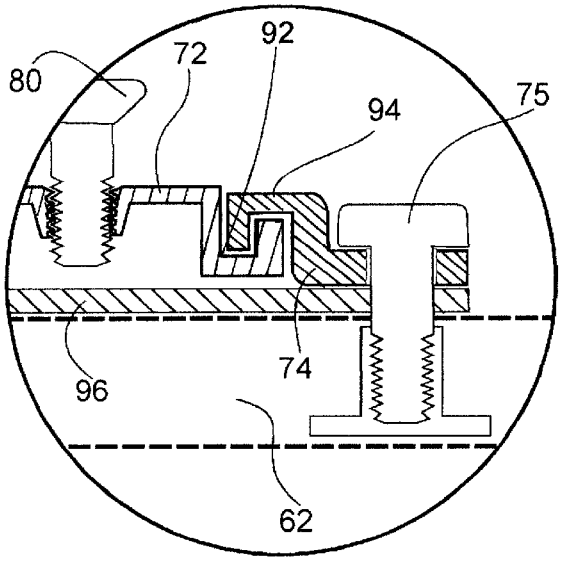
FIG. 9 is a detailed diagrammatic depiction of a preferred configuration of the swivel disk and the swivel disk retainer ring using a mating C-shaped design.

Referring to FIG. 9, in an alternate preferred embodiment of the present invention, the outer edge of the swivel disk 72 may be formed in a first C-shape 92. As such, in this embodiment, the swivel disk retainer ring 74 would be designed in a manner so that it has an outer edge formed in a second C-shape 94. The second C-shape 94 on the swivel disk retainer ring 74 is then used to hold the swivel disk 72 in place by being interlocked with the first C-shape 92. Therefore, during operation, the swivel disk 72 is capable of rotating within the swivel disk retainer ring 74 because of the mating C-shaped design.

As illustrated in FIGS. 8 and 9, a base friction plate 96 is connected with the bottom of the swivel disk retainer ring 74. The base friction plate 96 and the swivel disk retainer ring 74 are held together with the screws 75 and are connected with the top surface of the downhill sliding device 62. Even without the base friction plate 96, the screws 75 can still be used to attach the swivel disk retainer ring 74 to the top surface of the downhill sliding device 62. The base friction plate 96 is optimally designed to accommodate a wide range of boards and boot binding configurations. In the preferred embodiment, the screws 75 comprise a threaded screw or bolt which securely fastens the swivel disk retainer ring 74 to the downhill sliding device 62.

Figure 10:
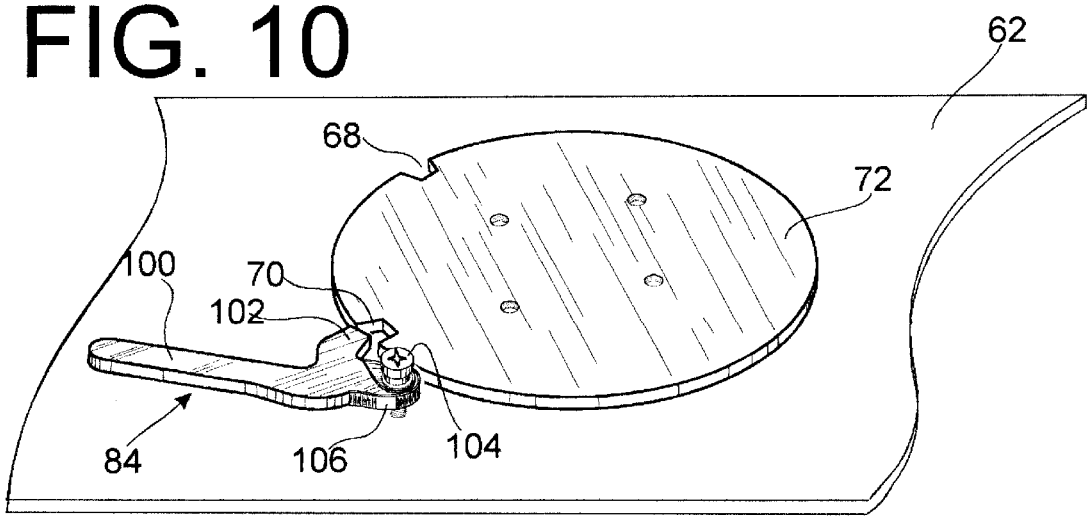
FIG. 10 is a detailed diagrammatic view of a preferred embodiment of the locking means utilized to forcibly engage the swivel disk.

Referring to FIG. 10, the locking mechanism 84 for selectively engaging the hard-lock coupling point 70 and the soft-lock coupling point 68 comprises a locking detent coupling arm 100 having a locking detent coupler 102 and a counter stop 104. In the invention, as previously stated, the locking detent coupler 102 is held forcibly engaged with the hard-lock coupling point 70 or the soft-lock coupling point 68 with a detent coupling compressive spring 106 that is connected with the snowboard 62. One skilled in the art would recognize that many different types of springs exist that are capable of applying resistive force and could be used in the disclosed embodiment. A feature of the disclosed invention is that the soft-lock coupling point 68 is designed so that a predetermined amount of pressure applied to the swivel ring 72 will cause the locking mechanism 84 to release the swivel ring 72.

Figure 11:
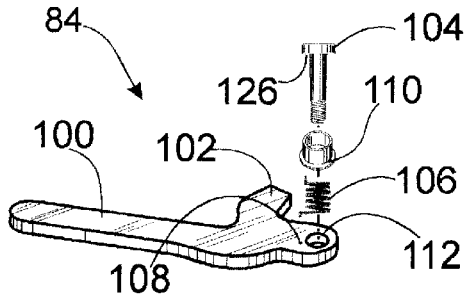
FIGS. 11–15 depict various alternative embodiments of the locking means.

As depicted in FIGS. 10–15, many different variations on the design of the locking mechanism 84 exist and would be recognized by those skilled in the art. FIG. 11 illustrates a locking mechanism 84 in which the detent coupling compressive spring 106 is a coil spring with one end made to imbed itself into a compressive spring bottom-lock hole 108 in the locking detent coupling arm 100. The spring extends upward through a detent hold-down collar 110 and into the top lock pin hole 126 on the counter stop 104. The counter stop 104 secures the locking mechanism 84 to the top of the snowboard by screwing into the threaded binding fastener holes 17 (see, e.g., FIG. 4) on the snowboard to a depth that allows the locking mechanism 84 to rotate about its center axis of the counter stop 104.

Figure 12:
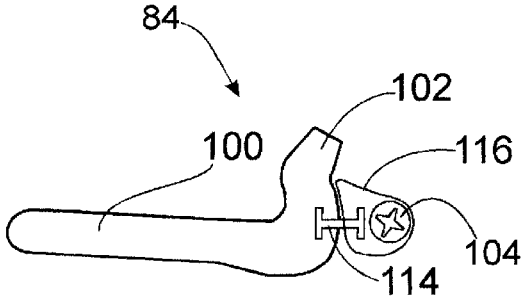
Figure 13:
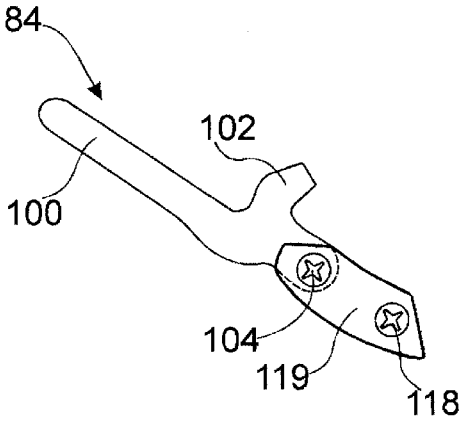

FIG. 12 illustrates another alternative embodiment of the locking mechanism 84 which uses a flex spring 114 to hold the locking detent coupler 102 in place. The counter stop 104 is mounted on top of a secondary riser 116 and the locking detent coupling arm 100 is held in place by the flex spring 114. During operation of the locking mechanism 84, the motion of the locking detent coupling arm 100 is guided by the shape of the secondary riser block 116. Referring to FIG. 13, another embodiment of the locking mechanism 84 is disclosed in which a secondary counter stop block 119 extends longer than in the previously discussed embodiments, separating the stop points of the secondary counter stop block 119. Such variations will be apparent to one skilled in the art and the disclosed invention is meant to cover a broad range of configurations and sizes of bindings.

Figure 14:
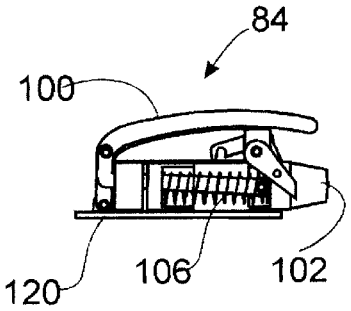

FIG. 14 represents another embodiment of the locking mechanism 84 that may be used in the present invention. The locking mechanism 84 comprises a locking detent coupling arm 100 connected with a locking detent coupler 102 which is held outwardly engaged by a detent coupling compressive spring 106. The base 120 of the locking mechanism 84 may be mounted on the downhill sliding device 62 or the swivel disk retainer ring 74 by any conventional means. During operation, the locking detent coupling arm 100 is pulled back in order to cause the locking detent coupler 102 to release the hard-lock coupling point 70. When the locking detent coupling arm 100 is released, the detent coupling compressive spring 106 causes the locking detent coupler 102 to forcibly engage the swivel ring 72. Once the locking detent coupler 102 reaches either the soft-lock coupling point 68 or the hard-lock coupling point 70, as a result of the snowboarder rotating their leg and foot, the locking detent coupler 102 latches due to the force of the compressive spring 106 and holds the swivel ring 72 securely in place as previously discussed.

Figure 15:
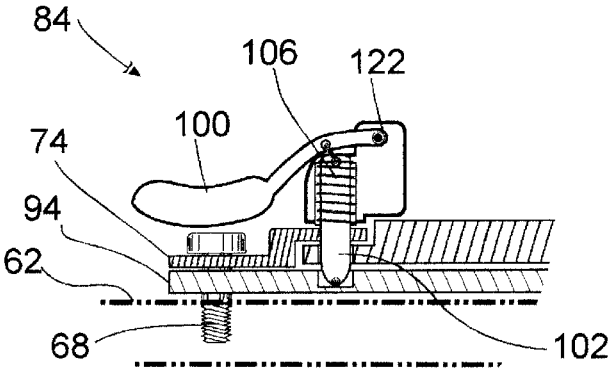

FIG. 15 represents yet another embodiment of the locking mechanism 84 in which the locking mechanism 84 is connected with the swivel disk retainer ring 74. The locking mechanism 84 comprises a locking detent coupling arm 100 connected with a locking detent coupler 102 and a locking detent housing 122. During operation, when the locking detent coupling arm 102 is lifted, it causes the locking detent coupler 102 to disengage either the soft-locking coupling point 68 or the hard-lock coupling point 70. In addition, the locking detent coupler 102 is held forcibly engaged with a detent coupling compressive spring 106. The detent coupling compressive spring 106 is connected with the locking detent coupler 102 and held in position within the locking detent housing 122. One skilled in the art would recognize that the detent coupling compressive spring 106 used in any of the disclosed preferred embodiments of the locking mechanism 84 may take many different shapes or sizes (i.e.—flat, coil, helix, etc.).

As previously discussed, the soft-locking coupling point 68 is capable of releasing the swivel ring 72 when a predetermined amount of pressure is applied to the swivel disk 74 by the snowboarder's leg and foot. This is done so that the snowboarder can simply twist his or her leg and lock the swivel ring 72 into the hard-lock coupling point 70 without requiring any manual manipulation of the locking mechanism 84. For instance, when a snowboarder gets off of the chair lift after riding back up the mountain, instead of having to bend over and release the device from the soft-lock coupling point 68, the snowboarder would simply twist his or her leg thereby locking the swivel disk in the hard-lock coupling point 70.

Figure 16:
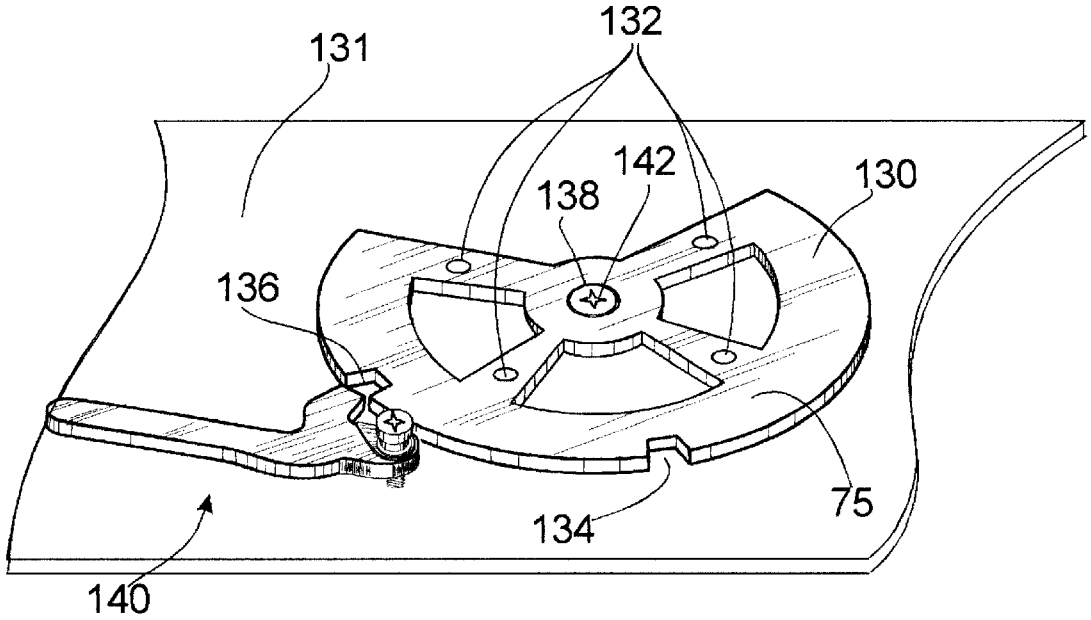
FIG. 16 depicts an alternative embodiment of the present invention which does not require an external swivel disk retainer ring.

Referring to FIG. 16, another preferred embodiment of the present invention discloses a swivel ring 130 that is designed in a manner so that the swivel ring 130 may be mounted directly with a snow recreation device 131 without requiring a swivel disk retainer ring. The swivel ring 130 has a plurality of threaded holes 132, a hard-lock coupling point 134, a soft-lock coupling point 136, and an aperture 138 for securing the swivel ring 130 with the snow recreation device 131. The aperture 138 secures the swivel ring 130 with the snow recreation device 131 so that the swivel ring 130 is capable of rotating. A locking detent device 140, capable of forcibly engaging the hard-lock coupling point 134 or the soft-lock coupling point 136, is provided so that the swivel ring 130 does not rotate when placed in the desired position.

In the disclosed preferred embodiment, the aperture 138 is located in the center of the swivel ring 130 for receiving a fastener 142 to secure the swivel ring 130 to the snow recreation device 131. The fastener 142 may comprise a bolt or any other device capable of securing the swivel ring 130 to the top of the snow recreation device 131 while still allowing it to rotate about its center axis. Threaded holes 132 allow any conventional boot binding frame to be fastened with the top surface of the swivel ring 130.

Figure 17:
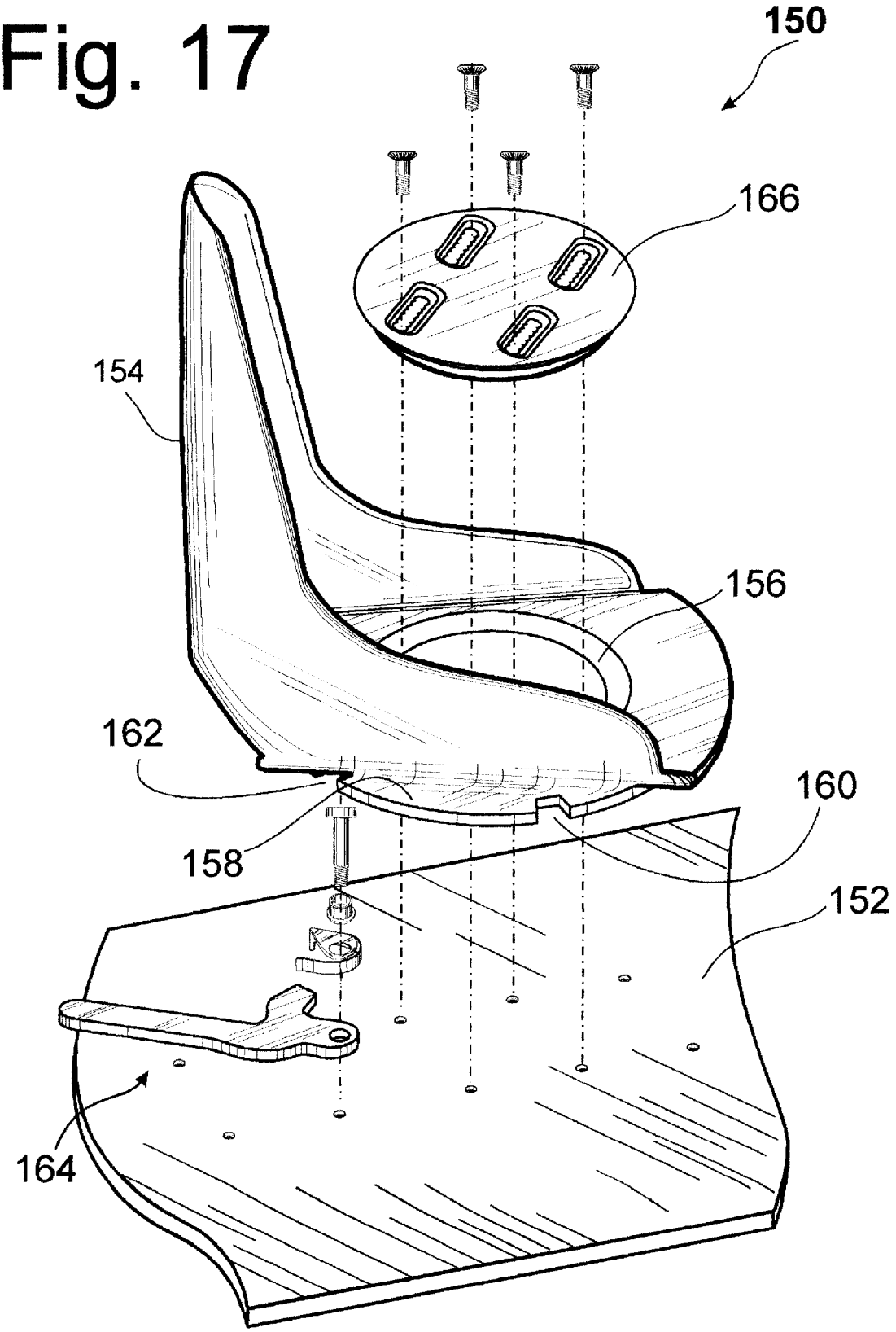
FIG. 17 depicts an alternative embodiment of the present invention wherein the boot binding frame is integrally formed having a swivel disk, and needing no external swivel disk retainer ring.

Referring to FIG. 17, another preferred embodiment of a rotating boot binding system 150 for a snowboard 152 is disclosed. The boot binding frame 154 has an internal slip ring 156 and a swivel ring 158 as an integral part of the base of the frame 154. The swivel ring 158 has a hard-lock coupling point 160 and a soft-lock coupling point 162. A locking detent device 164 is provided that is connected with the snowboard 152 for forcibly engaging the hard-lock coupling point 160 and the soft-lock coupling point 162. A slip ring retainer disk 166 having a smooth circumference is connected with the boot binding frame 154 by mating with the internal slip ring 156 and being secured with the snowboard 152. The slip ring retainer disk 166 allows the boot binding frame 154 to rotate about the slip ring retainer disk 166.

Figure 18:
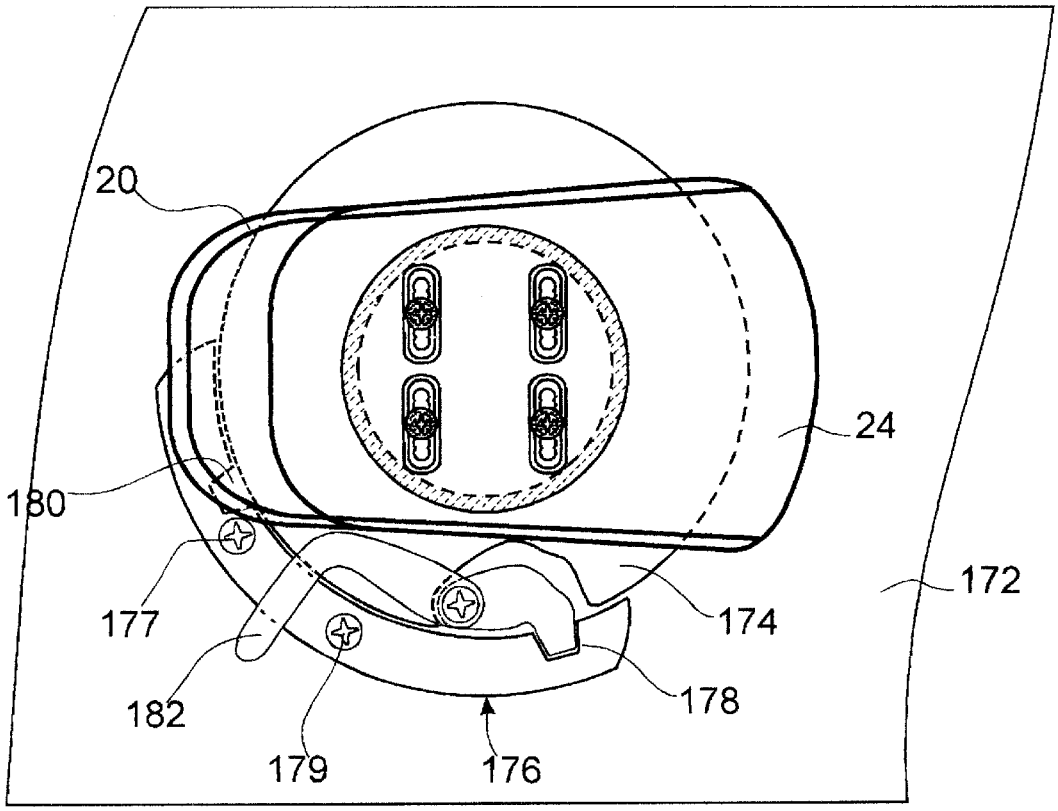
FIG. 18 depicts an alternative embodiment of the present invention wherein the soft-lock coupling point and the downhill locking coupling point are located on a swivel disk ring.

As depicted in FIG. 18, another preferred embodiment of the present invention discloses a rotating binding system 170 for use with a downhill sliding device 172. In the invention, a swivel disk 174 is connected with the top surface of the downhill sliding device 172. The swivel disk 174 is capable of rotating in relation to the top surface of the downhill sliding device 172. A latching ark 176 is provided that mates with a portion of the outer edge of the swivel disk 174. The latching ark 176 has a hard-lock coupling point 180 and a soft-locking coupling point 178. A locking means 182 is connected with the swivel disk 174 for selectively engaging the hard-lock coupling point 180 and the soft-locking coupling point 178 so that the swivel 174 will not rotate in its respective position. In this preferred embodiment, the relative positioning of the hard-lock coupling point 180 and the soft-lock coupling point 178 are reversed in comparison to that disclosed in the other preferred embodiments, and two counters stops 177 and 179 are shown as described earlier in FIG. 4.

Various materials or combinations of materials may be used for the components of the present invention, such as high-strength plastics, such as polycarbonate, metals, composites, ceramics and the like, provided that the materials are able to withstand the significant forces exerted during the operation of a snowboard. In some instances, a material having low friction properties is needed so that the boot binding frames and the retainer disks are capable of providing a slipping function so that the frames will rotate. Most of these components may be formed by metal forming, injection molding of plastics, or many other known manufacturing techniques. In addition, a protective housing may be placed around the assembly to protect it from dirt, snow and ice.

Fabrication of the front snowboard bindings may either be as base plate upon which numerous bindings may be initially mounted, as an integral part of a binding design, as a retrofitted product installed later between the snowboard and the boot binding frame, or with some components formed so as to be incorporated onto or into the snowboard itself. The dual-locking interface of the present invention may easily be mounted directly on a snowboard or, in the alternative, may utilize a separate base plate, or may be positioned between an interface plate and the snowboard.

Of course, it should be understood that a wide range of changes and modifications can be made to the embodiments described above. It is, therefore, intended that the foregoing description illustrates rather than limits this invention, and that it is the following claims, including all equivalents, which define this invention

What is claimed is:

1. A dual-locking snowboard rotating binding system for a snowboard presenting a generally planar mounting surface extending in a longitudinal axis and transverse axis, the longitudinal axis corresponding to the length of the snow board and the transverse axis corresponding to the width of the snowboard, the binding system comprising:

a binding frame for receiving a person's foot and retaining the foot therein, a rotating binding system having a first portion attached to the binding frame and having a second portion attached to the mounting surface, the first and second portions interfitting to swivel with respect to each other about a rotation axis perpendicular to the mounting surface but to be retained against movement with respect to each other along the rotation axis, and a locking mechanism releasably holding the first portion and second portion of the rotating binding system at either of a first rotative position with the binding frame positioned to hold the foot aligned generally with the longitudinal axis and a second rotative position with the binding frame positioned to hold the foot aligned generally with the transverse axis;

the locking mechanism further having a lever extending from the rotating binding system for actuation by a user of the snowboard, wherein the locking mechanism provides:

(1) a soft-lock when the rotating binding system is in the first rotative position in which the first portion and second portion of the rotating binding system may be further rotated relative to each other by pressure only on the binding frame by the user's foot and (2) a hard-lock when the rotating binding system is in the second rotative position in which the first portion and second portion of the rotating binding system may be further rotated relative to each other only by activation of the lever extending from the rotating binding system.

2. The rotating binding system of claim 1, wherein the second portion has a plurality of threaded holes for receiving a plurality of fasteners, said plurality of threaded holes opening on the top surface of the second portion.

3. The rotating binding system of claim 1, further comprising a base friction plate connected with the bottom of the second portion.

4. The rotating binding system of claim 1 wherein the first portion is a ring and the second portion is a retainer having a disk-shaped body section fitting within the ring and a flange section extending radially outward from an upper edge of the retainer over the ring to sandwich the ring between the flange section and the planar mounting surface of the snowboard.

5. The rotating binding system of claim 1 wherein the first portion is a disk and the second portion is a retainer ring having a disk-shaped opening surrounding the ring and a flange section extending radially inward from an upper edge of the retainer ring over the disk to sandwich the disk between the flange section and the planar mounting surface of the snowboard.

6. The rotating binding system of claim 1 wherein the locking mechanism is a spring biased lever supporting a tooth alternatively engaging a notch in the first portion at the first and second rotative positions.

7. The rotating binding system of claim 1 wherein the locking mechanism is a spring biased lever supporting a tooth alternatively engaging a notch in the second portion at the first and second rotative positions.

8. The rotating binding system of claim 2, wherein said-plurality of threaded holes secure the binding frame to the top surface of the second portion.

9. The rotating binding system of claim 2, further comprising a riser having a plurality of apertures, said riser being connected between-the second portion and first portion to increase the height of the binding frame from the mounting surface.

10. The rotating binding system of claim 2, wherein the outer edge of the second portion has a cross-section formed in a first C-shape.

11. The rotating binding system of claim 3, wherein the base friction plate and the second portion are provided with a connector for connecting the base friction plate and the second portion with the top surface of the downhill sliding device.

12. The rotating binding system of claim 10, wherein the first portion has an outer edge has a cross section formed in a second C-shape, said second C-shape being used to hold the second portion in place by being connected with the first C-shape while allowing the second portion to rotate within the first portion.

* * * * *